US009039250B2

(12) United States Patent
Man

(10) Patent No.: US 9,039,250 B2
(45) Date of Patent: May 26, 2015

(54) REFLECTOR ASSEMBLY FOR ELIMINATING UNWANTED STRAY LIGHTS

(71) Applicant: Shiu-Fai Stephen Man, N.T. (HK)

(72) Inventor: Shiu-Fai Stephen Man, N.T. (HK)

(73) Assignee: KAPER INDUSTRIAL LIMITED, N.T., Hong Kong (HK)

( * ) Notice: Subject to any disclaimer, the term of this patent is extended or adjusted under 35 U.S.C. 154(b) by 0 days.

(21) Appl. No.: 13/958,630

(22) Filed: Aug. 5, 2013

(65) Prior Publication Data

US 2015/0036357 A1 Feb. 5, 2015

(51) Int. Cl.

| | |
|---|---|
| ***F21V 5/00*** | (2006.01) |
| ***F21V 13/04*** | (2006.01) |
| *F21Y 101/00* | (2006.01) |
| *F21Y 101/02* | (2006.01) |
| *F21V 7/00* | (2006.01) |
| *F21V 7/04* | (2006.01) |
| *F21V 13/14* | (2006.01) |
| *F21V 13/08* | (2006.01) |

(52) U.S. Cl.

CPC ..... *F21V 13/04* (2013.01); *F21Y 2101/00* (2013.01); *F21Y 2101/02* (2013.01); *F21V 7/00* (2013.01); *F21V 7/04* (2013.01); *F21V 13/14* (2013.01); *F21V 13/08* (2013.01)

(58) Field of Classification Search

CPC ... F21Y 2101/00; F21Y 2101/02; F21V 7/00; F21V 7/04; F21V 7/06; F21V 13/04; F21V 13/14; F21V 13/08; B63B 2101/08

USPC ..... 362/329, 328, 186, 187, 188, 208, 245, 362/285, 296.08, 296.1, 311.07, 311.12, 362/327

See application file for complete search history.

(56) References Cited

U.S. PATENT DOCUMENTS

| | | | | |
|---|---|---|---|---|
| 5,730,521 | A * | 3/1998 | Spink et al. | 362/223 |
| 2003/0002151 | A1* | 1/2003 | Yano | 359/443 |
| 2005/0270775 | A1* | 12/2005 | Harbers et al. | 362/231 |

* cited by examiner

*Primary Examiner* — Anh Mai
*Assistant Examiner* — Glenn Zimmerman

(57) ABSTRACT

A reflector assembly for eliminating unwanted stray lights comprising a reflector body having a reflector body focal point on a reflector body optical axis where a light source is positioned and a front opening for receiving a lens, wherein the lens is configured to reflect light rays which emanate from the light source to strike the lens to the reflector body which is configured to reflect the light rays reflected by the lens back to the light source, and to reflect light rays which emanate from the light source and reflected by the reflector body to strike the lens back to the light source.

2 Claims, 1 Drawing Sheet

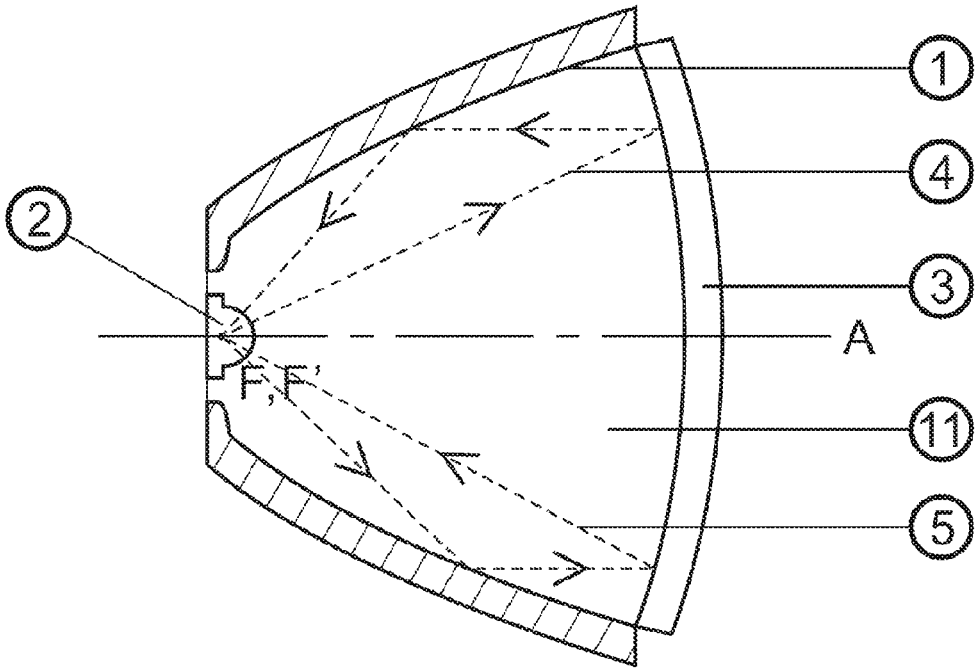
1
4
2
3
A
F, F'
11
5

REFLECTOR ASSEMBLY FOR ELIMINATING UNWANTED STRAY LIGHTS

BACKGROUND OF THE INVENTION

The present invention relates to a reflector assembly for lighting devices such as flashlights and more particularly pertains to a reflector assembly for eliminating unwanted stray lights.

A reflector assembly generally comprises a reflector body and a lens. A light source, such as an LED or a light bulb, is positioned at a tail end of the reflector. To achieve better lighting efficiency, the reflector body is configured to reflect light rays emanating from the light source and striking on the reflector body towards a predetermined direction, for example in a parallel forward direction as in the case of a parabolic reflector. By means of the reflector assembly, the majoring of light rays emanating from the light source either strike the lens directly, or strike the reflector body and reflected by the reflector body towards the lens. However, after the light rays strike on the lens, a portion of the light rays is reflected from the lens back to the reflector body; as the reflector body usually is configured to reflect light rays from the light source but not from anywhere else towards a predetermined direction, the portion of light rays is then reflected by the reflector body in various directions, resulting in unwanted stray lights. One way to eliminate unwanted stray lights is to coat the lens with anti-reflective coating. However, the coating process results in higher product costs; besides, anti-reflective coating can only be applied to certain material, which results in a limited choice of materials for the lens.

BRIEF SUMMARY OF THE INVENTION

In view of the aforesaid disadvantages now present in the prior art, the object of the present invention is to provide a reflector assembly for eliminating unwanted stray lights.

To attain this, the present invention comprises a reflector body having a reflector body focal point on a reflector body optical axis where a light source is positioned and a front opening for receiving a lens, wherein the lens is configured to reflect light rays which emanate from the light source to strike the lens to the reflector body which is configured to reflect the light rays reflected by the lens back to the light source, and to reflect light rays which emanate from the light source and reflected by the reflector body to strike the lens back to the light source.

In one embodiment, the reflector body is substantially parabolic so that light rays which emanate from the light source to strike the reflector body are reflected in a forward direction parallel to the reflector body optical axis, and the lens has a substantially spherically concave curvature with respect to the light source with a lens reflective focal point overlapping with the reflector body focal point, and a radius of curvature equal to two times the distance from the lens to the lens reflective focal point, so that light rays which emanate from the light source to strike the lens are reflected by the lens in a backward direction parallel to the reflector body optical axis to the reflector body which is configured to reflect the light rays reflected by the lens back to the light source, and to reflect light rays which emanate from the light source and reflected by the reflector body to strike the lens in a direction parallel to the reflector body optical axis back to the light source.

In another embodiment, the reflector body is configured to reflect light rays which emanate from the light source to strike the reflector body in a forward direction to focus at a point at a predetermined distance. In this case, optical simulation software such as LightTools and Tracepro may be used to generate the profiles of the reflector body and the lens.

BRIEF DESCRIPTION OF THE DRAWINGS

FIG. 1 is a cross sectional view of a reflector assembly in accordance with a preferred embodiment of the present invention.

DETAILED DESCRIPTION OF THE INVENTION

The present invention is further described in detail with the following embodiment and the accompanying drawing.

As illustrated in FIG. 1, the reflector assembly of the present invention comprises a reflector body 1 having a reflector body focal point F on a reflector body optical axis A where a light source 2 is positioned and a front opening 11 for receiving a lens 3. The lens 3 is configured to reflect light rays which emanate from the light source 2 to strike the lens 3 to the reflector body 1 which is configured to reflect the light rays reflected by the lens 3 back to the light source 2, an exemplary path of one of such light rays is represented by the dashed-line light ray representation 4; the lens 3 is also configured to reflect light rays which emanate from the light source 2 and reflected by the reflector body 1 to strike the lens 3 back to the light source 2, an exemplary path of one of such light rays is represented by the dashed-line light ray representation 5.

In this embodiment, the reflector body 1 is substantially parabolic so that light rays which emanate from the light source 2 to strike the reflector body 1 are reflected in a forward direction parallel to the reflector body optical axis A, and the lens 3 has a substantially spherically concave curvature with respect to the light source 2 with a lens reflective focal point F' overlapping with the reflector body focal point F, and a radius of curvature equal to two times the distance from the lens 3 to the lens reflective focal point F', so that light rays which emanate from the light source 2 to strike the lens 3 are reflected by the lens 3 in a backward direction parallel to the reflector body optical axis A to the reflector body 1 which is configured to reflect the light rays reflected by the lens 3 back to the light source 2, and to reflect light rays which emanate from the light source 2 and reflected by the reflector body 1 to strike the lens 3 in a direction parallel to the reflector body optical axis A back to the light source 2.

The present embodiment makes use of the principle of spherical concave mirror to enable light rays striking the lens are either reflected back to the light source or to the reflector body which reflects the light rays back to the light source. As a result, unwanted stray lights resulting from light rays reflected by the lens are eliminated without the application of any anti-reflective coating.

In other embodiments not shown in the drawings, the reflector body may be configured to reflect light rays which emanate from the light source to strike the reflector body in a forward direction to focus at a point at a predetermined distance. In this case, optical simulation software such as LightTools and Tracepro may be used to generate the profiles of the reflector body and the lens. Besides, it should be appreciated that as the light source is not a single point, even in the embodiment as shown in the drawing, the reflector body may not be perfectly parabolic and the lens may not be perfectly spherically concave, and optical simulation software such as LightTools and Tracepro may be used to generate the profiles of the reflector body and the lens to obtain optimal effect.

The above embodiment is a preferred embodiment of the present invention. The present invention is capable of other embodiments and is not limited by the above embodiment. Any other variation, decoration, substitution, combination or simplification, whether in substance or in principle, not deviated from the spirit of the present invention, is replacement or substitution of equivalent effect and falls within the scope of protection of the present invention.

What is claimed is:

1. A reflector assembly for eliminating unwanted stray lights comprising a reflector body having a reflector body focal point on a reflector body optical axis where a light source is positioned and a front opening for receiving a lens, wherein the lens is configured to reflect light rays which emanate from the light source to strike the lens to the reflector body which is configured to reflect the light rays reflected by the lens back to the light source, and to reflect light rays which emanate from the light source and reflected by the reflector body to strike the lens back to the light source; wherein the reflector body is substantially parabolic so that light rays which emanate from the light source to strike the reflector body are reflected in a forward direction parallel to the reflector body optical axis, and the lens has a substantially spherically concave curvature with respect to the light source with a lens reflective focal point overlapping with the reflector body focal Point, and a radius of curvature equal to two times a distance from the lens to the lens reflective focal point, so that light rays which emanate from the light source to strike the lens are reflected by the lens in a backward direction parallel to the reflector body optical axis to the reflector body which is configured to reflect the light rays reflected by the lens back to the light source, and to reflect light rays which emanate from the light source and reflected by the reflector body to strike the lens in a direction parallel to the reflector body optical axis back to the light source.

2. The reflector assembly as in claim 1, wherein the reflector body is configured to reflect light rays which emanate from the light source to strike the reflector body in a forward direction to focus at a point at a predetermined distance.

* * * * *